United States Patent [19]

Schmitz

[11] Patent Number: 4,718,219

[45] Date of Patent: Jan. 12, 1988

[54] APPARATUS FOR SPIRAL WRAPPING A LOAD BY A WEB OF STRETCHED PLASTIC FILM

[75] Inventor: Dieter Schmitz, Solingen, Fed. Rep. of Germany

[73] Assignee: Cyklop International AG, Cologne, Fed. Rep. of Germany

[21] Appl. No.: 43,885

[22] Filed: Apr. 29, 1987

[30] Foreign Application Priority Data

May 2, 1986 [DE] Fed. Rep. of Germany ..... 3614775

[51] Int. Cl.[4] ..... B65B 11/04

[52] U.S. Cl. ..... 53/556; 53/587; 53/211

[58] Field of Search ..... 53/556, 587, 588, 211, 53/441

[56] References Cited

U.S. PATENT DOCUMENTS

| | | | |
|---|---|---|---|
| 4,302,920 | 12/1981 | Lancaster | 53/587 |
| 4,317,322 | 3/1982 | Lancaster | 53/556 |
| 4,497,159 | 2/1985 | Lancaster | 53/556 |

*Primary Examiner*—John Sipos

*Attorney, Agent, or Firm*—Spensley Horn Jubas & Lubitz

[57] ABSTRACT

The apparatus for spiral wrapping a load comprises a carriage which is mounted moveably in the vertical direction on a fixed base-mounted stand and to which two prestretch rollers each coupled with simultaneous rotation with a frictionally engageable wheel and a film supply roll are secured. The downstream prestretch roller and its associated frictionally engageable wheel are carried by a two-arm assembly moveable around a vertical axis and may be moved by moving the member in order to engage or to disengage the frictionally engageable gearing mechanism. A switching assembly which keeps the gearing mechanism disengaged at the beginning of the wrap and thereafter allows an engagement of the friction gearing mechanism until the end of the wrap comprises a base-supported, vertically displaceable and upwardly pretensioned cam member with an upper abutment surface and a lateral cam surface and a switching element coupled rotatably with one arm member of the two-arm member. The switching assembly is spaced, at a fixed distance, relative to the moveable prestretch roller, pushes the cam member downward upon contact with the abutment surface and, being in contact with the cam surface, keeps the moveable prestretch roller disengaged at the beginning of the wrap.

14 Claims, 6 Drawing Figures

Fig.1A
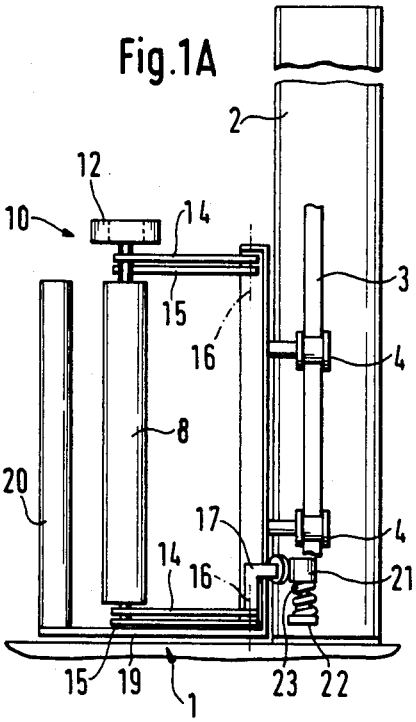
Fig.2A
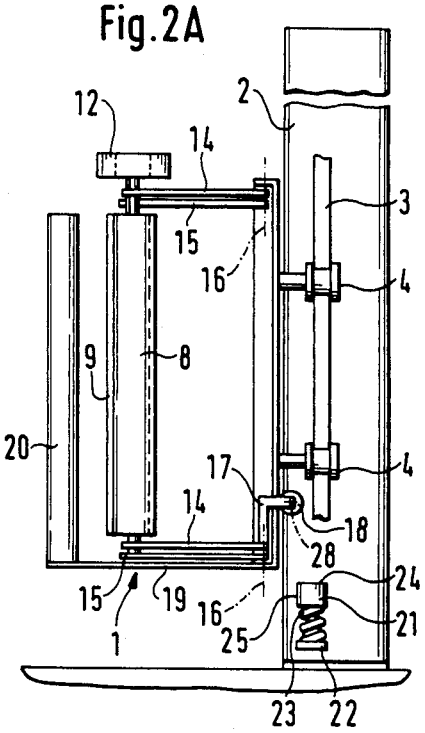
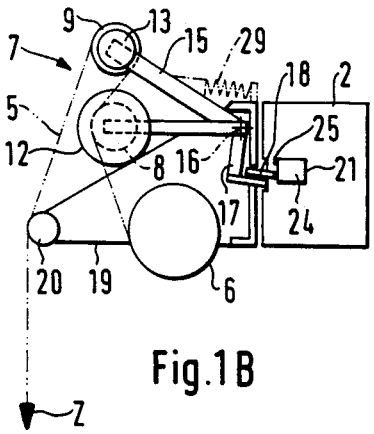
Fig.1B
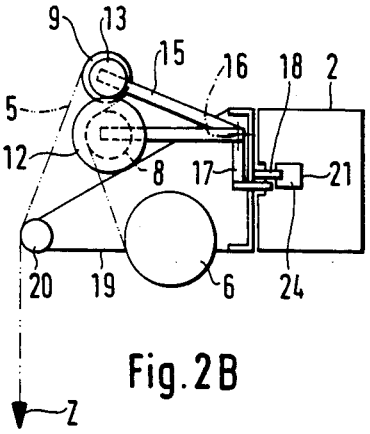
Fig.2B

APPARATUS FOR SPIRAL WRAPPING A LOAD BY A WEB OF STRETCHED PLASTIC FILM

BACKGROUND OF THE INVENTION

1. Field of the Invention

The present invention generally relates to packaging and more particularly to an apparatus for spiral wrapping a load by a web of stretched plastic film by the relative rotation of said load and a film dispenser roller.

2. Prior Art

Numerous conventional wrapping machines develop the forces needed for pulling the web of wrapping film off the roller on which said web of film is supplied, for stretching the stretchable film and for the transportation of said web of film from said film supply roller to the load by the relative rotation of the load to be wrapped and the film dispenser roller, said forces being transmitted along the film web. In such wrapping processes, the tensile load to which the web of film is exposed should be as small as possible from the beginning of the wrapping operation until the completion of at least part of the first relative rotation, the first part of the film web being therefore wound loosely and without elongation onto the load (see West German Pat. No. 24,13,807). The reduction in film tension at the beginning of the wrapping operation is particularly important in the case of a stretch wrapper device provided with two spaced prestretch rollers interconnected by gearing to operate at two different peripheral speeds having a constant relationship to each other to elongate the film web at ambient temperature by 80% or even more.

U.S. Pat. No. 4,497,159 (Lancaster, III) divulges an apparatus for applying stretched plastic film to loads using a prestretching mechanism in the form of two frictionally engaged rollers driven by the film web at different speeds to elongate the plastic film between the engaged rollers beyond its yield strength. An initial portion of the wrap is placed on the load in a substantially unstretched condition, the rollers being forced apart at the beginning of the wrapping cycle. To force the rollers apart, a cam assembly is mounted on a carriage which may be driven upward and downward, keeping the moveable prestretch roller and its associated frictionally engageable wheel disengaged until said carriage has travelled a certain distance at the beginning of each new wrapping cycle. The cam assembly known from said patent implies certain disadvantages, as it necessitates the use of a bottom plate below the carriage limiting the downward travel of said carriage and interfering with low wrapping operations. The floor clearance of state-of-the-art pallet stretch wrappers such as the machine marketed by the applicant under the trademark "Robopac" travelling around the pallet to be wrapped is reduced by said bottom plate, said reduction in floor clearance being particularly cumbersome if the floor surface is irregular or uneven.

SUMMARY OF THE INVENTION

It is an object of the present invention to provide for a stretch wrapping apparatus with a simple switching assembly which does not reduce or limit floor clearance or carriage travel.

According to the teachings of the present invention, an apparatus for spiral wrapping a load is provided with a vertically moveable carriage means secured to a base-mounted frame. Said carriage means holds two prestretch rollers each coupled for simultaneous rotation with frictionally engageable wheel means and a film dispenser roller. The downstream prestretch roller and the associated frictionally engageable wheel are mounted on a moveable support assembly and may be moved by moving said support assembly to engage or to disengage frictionally engageable gearing. The switching assembly which keeps said friction gearing disengaged at the beginning of each wrapping cycle and thereafter allows the engagement of said gearing until the end of said wrapping cycle comprises a cam member supported on a base-mounted component which may be displaced and is pretensioned upwardly and provided with an upper abutment surface and a lateral cam surface as well as a switching element coupled with the moveable support assembly. Said switching element is spaced by a defined distance relative to the moveable prestretch roller, pushes said cam member downward upon contact with the abutment surface thereof and is in contact with the lateral cam surface at the beginning of the wrap, keeping the moveable prestretch roller disengaged and thereby disabled.

The present invention eliminates the need for a bottom plate reducing or limiting floor clearance or carriage travel. The cam member provided for the disengagement and the engagement of the friction gearing is spring-loaded in the upward direction and may be arranged at practically any height of the apparatus at any point convenient for installation and access preferably on the base-mounted stand. The carriage means only carries the switching element which performs reliably its function of preventing film stretching by the moveable prestretch roller at the beginning of the wrap, because it is directly coupled with the moveable support of the moveable prestretch roller for simultaneous movement therewith. The arm member holding the moveable prestretch roller may be adapted for the switching element to be appropriately adapted to the position and the spring load of the base-supported cam member. The number of parts of the switching assembly divulged by the present invention is at a minimum and said parts may be of a simple design allowing cost efficient manufacturing and assembly.

The present invention is preferably used for a wrapper of the type illustrated by West German Pat. No. 30,43,807 wherein the plastic film for wrapping the load is stretched between two spaced prestretch rollers operating at two different peripheral speeds kept in a predetermined ratio by friction gearing, but the present invention may also be used in conjunction with conventional brake devices wherein the moveable prestretch roller may be braked by the friction gearing due to the tension of the web of plastic film.

In a preferred embodiment of the present invention, the at least one moveable support is in the form of a two-armed member, one arm holding the moveable prestretch roller mounted coaxially with one frictionally engageable wheel means and the other arm holding the switching element. Such a two-armed member may be adapted easily to the design and the kinematics of the wrapping machine and also allows a direct transmission of force from the switching element to the frictionally engageable gear means.

The switching element is preferably a cam roller mounted to rotate freely around a horizontal axis of rotation. In a further embodiment of the present invention providing for coupled frictionally engageable wheel means, the abutment surface of the cam member only engages in the path of travel of one segment of the circumference of the cam roller and the axis of said cam roller is outside said abutment surface so that, upon release of the film tension, said roller is moved laterally by the cam member pretensioned upwardly and the spring load to which said cam member is exposed is exploited for disengaging the two frictionally engaged gear wheels by means of said cam roller. In an alternative or a further embodiment of the present invention, a spring may be provided for pretensioning the moveable arm holding the moveable prestretch roller and its associated gear wheel to move said arm into the disengaged position as the film tension is released.

In the present invention, the form mainly of the abutment surface of the cam member is not vital. Said surface may hence be inclined, bent or plane and may allow line or area contact with the switching element. It is merely essential that said abutment surface is arranged in the path of switching element travel so that said switching element brings to bear, during the final phase of the wrapping cycle, a vertical force acting upon said abutment surface of the cam member. In a particularly simple embodiment of the present invention, said abutment surface has a horizontal extension, whilst the cam surface is in a vertical plane. The cam member is guided by vertical guides allowing only vertical cam member movement, the cam member absorbing transverse forces acting upon the cam surface without any displacement of said cam member in the horizontal direction.

Although the invention is set forth in the claims, further details, characteristics and advantages may be better understood by reference to the accompanying drawings forming a part hereof.

BRIEF DESCRIPTION OF THE DRAWINGS

The apparatus for spiral wrapping a load by a web of stretched plastic film will now be described with the help of a preferred embodiment of the present invention illustrated in the accompanying drawings in which FIGS. 1A and 1B disclose a side view and a top view of an embodiment of the wrapping machine at the beginning of the wrapping cycle, the friction gearing being kept disengaged by the cam roller supported on the lateral cam surface of the cam member;

FIGS. 2A and 2B are views similar to the views in FIG. 1, the carriage having moved upward and the cam roller having been lifted off the cam member;

DETAILED DESCRIPTION OF THE INVENTION

The embodiment of the spiral wrapping machine disclosed by the present invention which is shown by the accompanying drawings is provided with a carriage means 1 which may move up and down on its rolls 4 on guide rails 3 secured vertically to a base-mounted stand 2.

Figure 4:
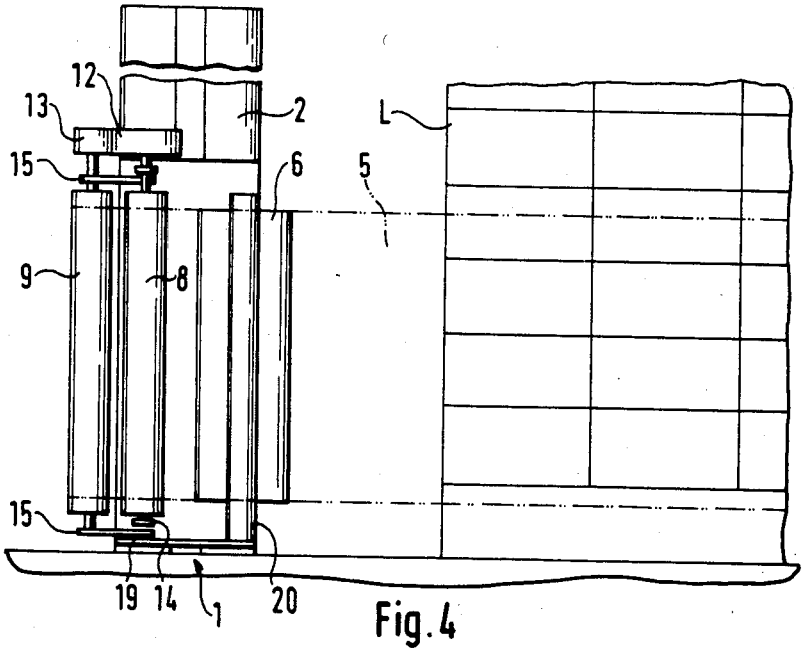
FIG. 4 is a side view of the two prestretch rollers with their associated frictionally engageable wheels being disengaged along a line at a right angle relative to the side views of FIGS. 1A and 2A.

Said carriage 1 carries all essential components of the apparatus for wrapping a load L (see FIG. 4) by a web of stretched plastic film 5 including a film supply roller 6 from which said web of stretchable plastic film 5 is pulled off during the wrapping operation by the relative movements of carriage 1 and load L and a prestretching device 7 comprising two spaced parallel prestretch rollers 8 and 9 and frictional gearing 10 with frictionally engageable wheels 12 and 13. The diameter of prestretch rollers 8 and 9 are equal and each prestretch roller is coupled by a vertical shaft for simultaneous rotation with one of frictionally engageable wheels 12 and 13. The diameter of the downstream frictionally engageable wheel 13 is substantially smaller than the diameter of the upstream frictionally engageable wheel 12 so that, when friction gearing 7 is engaged (see FIG. 2B), the peripheral speed of the downstream prestretch roller 9 exceeds the peripheral speed of the upstream prestretch roller 8 by a ratio determined by the ratio between the circumferences of frictionally engageable wheels 12 and 13. It is apparent that the peripheral speeds of prestretch rollers 8 and 9 will also differ, if the diameters of said two rollers differ.

The shaft of prestretch roller 8 is firmly connected with carriage means 1 by arm means 14. To hold the downstream prestretch roller 9 and its associated frictionally engageable wheel 13, a moveable two-arm member 15 is provided on a vertical axis of rotation 16.

In the embodiment of the present invention depicted in the accompanying drawings, the bottom member of the moveable two-arm member 15 is coupled with a second arm member which carries a cam roller 18 rotatable around a vertical axis. The web of plastic film 5 leaves carriage means 1 being guided by guide roller 20 mounted at one end on a floor plate 19 of carriage means 1.

Figure 3:
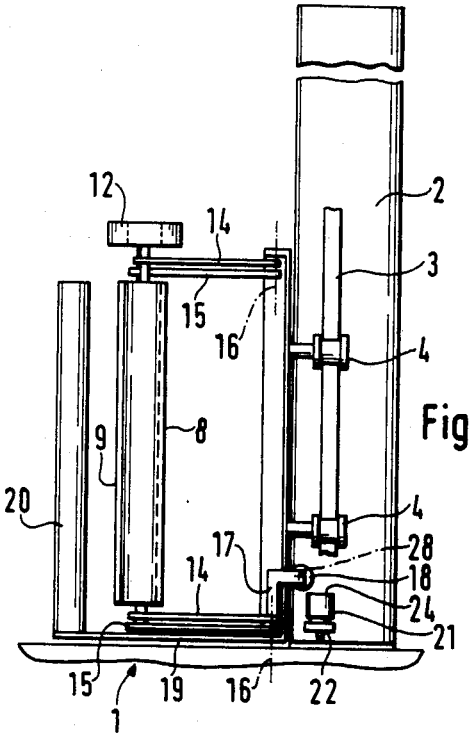
FIG. 3 is a side view as in FIGS. 1A and 2A showing the second phase of the wrapping cycle wherein the cam roller resting on the abutment surface of the cam member pushes the cam member down in a direction opposite to the direction of the spring force, the friction gearing being engaged.

Cam roller 18 interacts with vertically displaceable cam member 21 supported on a stand-mounted console and pretensioned upwardly by spring means which may be a helical spring 23 as shown in the accompanying drawings. In the embodiment of the present invention depicted in the drawings forming part hereof, said cam member 21 is provided with a flat abutment surface 24 and a lateral cam surface 25. Said abutment surface 24 is arranged in the vertical path of travel of cam roller 18 moving together with carriage means 1. The interaction of components 21, 18 and 17 forming a switching assembly will now be explained by reference to the different carriage positions during the wrap of the palleted load L as shown by FIGS. 1 through 3.

Referring first to FIGS. 1A and 1B, each wrapping cycle commences with carriage means 1 being in its bottom position. In said position, the moveable frictionally engageable wheel 13 is spaced relative to frictionally engageable wheel 12 secured firmly to carriage means 1, the friction gearing being disengaged. Said disengaged position of frictionally engageable wheel 13 is maintained by means of cam roller 18 engaging the lateral cam surface 25 of cam member 21 when the tensional force brought to bear by the web of plastic film 5 in the direction of arrow Z pushes the downstream prestretch roller 9 and its associated frictionally engageable wheel 13 towards the engaged position at the beginning of the wrapping cycle, the vertical cam surface 25 blocking the motion of the moveable arm member 15 over arm member 17 causing wheels 12 and 13 to engage until cam roller 18 is lifted off cam surface 25 after a certain upward movement of carriage 1 allowing said cam roller 18 to move over without being retained by cam surface 25. During this initial phase of the wrapping cycle, the wrap around load L and the web of plastic film 5 are exposed to relatively little tension resulting from the transportation of said web of plastic film and from pulling said film off film supply roller 6, as rollers 8 and 9 merely guide said web of film in a fashion similar to guide roller 20.

As cam roller 18 is released from cam surface 25, arm member 15 moves across the web of film 5 allowing the frictionally engageable wheels 12 and 13 to engage. Said engagement causes prestretch rollers 8 and 9 to rotate at different peripheral speeds so that the web of stretchable plastic film 5 is elongated between said two rollers in a controlled fashion, the stretch depending upon the ratio between the circumferences of the frictionally engaged wheels 12 and 13. The frictional engagement coupling rollers 12 and 13 is maintained, as the web of stretchable plastic film remains tensioned, while carriage means 1 moves upward to its upper stop and returns downward from its upper stop to its lower stop. FIGS. 2A and 2B show the relative positions of cam roller 18 and cam member 21 in an intermediate carriage position, the frictional gearing being engaged.

Towards the end of the wrapping cycle as carriage means 1 approaches its lower stop cam roller 18 hits the abutment surface 24 of cam member 21 said abutment surface 24 being in a horizontal plane in the embodiment of the present invention illustrated by the accompanying drawings. As carriage means 1 is lowered further, cam roller 18 pushes down the abutment surface 24 of upwardly pretensioned cam member 21, as said cam member 21 cannot move sideways. When the carriage means 1 has reached its lower stop (see FIG. 3) and the web of plastic film has been cut at the load thereby removing the tensile force acting in the direction of arrow Z and keeping the friction gearing engaged, arm member 15 returns into its disengaged position shown in FIG. 1. The force required for said arm member so to return may, by way of example, be applied by a helical spring 29 shown by a broken line in FIG. 1. In the embodiment of the present invention shown by the accompanying drawings, the form and the arrangement of the components of the switching assembly interacting in the lower stop position of carriage means 1 are such that the loading of spring means 23 imparted to cam member 21 may be exploited for returning arm member 15. As FIG. 3 shows, only one outer segment of cam roller 18 is supported on the edge of cam member 21 above cam surface 25. The cam roller axis of rotation 28 is outside the path of travel of cam member 21 loaded by spring 23. As cam member 21 returns upward, a horizontal force is brought to act upon cam roller 18 causing the moveable arm member 15 together with the frictionally engaged wheel 13 and prestretch roller 9 to move sideways thereby disengaging the frictional gearing. The vertical guide of cam member 21 only represented schematically in the drawings prevents cam member 21 from being displaced to one side (to the right in the accompanying drawings).

The console 22 supporting cam member 21 and spring 23 may be arranged at any height of stand 2 allowing sufficient floor clearance even if cam member 21 is pushed down as shown in FIG. 3. The arm member 17 for supporting cam roller 18 is arranged and sized to be adapted to the position of cam member 21. The arm member 17 and cam roller 18 may be associated with the upper arm of moveable arm member 15 without changing the mode of operation of the switching assembly as the two arm members 15 are coupled for simultaneous movement.

It is understood by anyone versed in the art that the scope of the present invention is not limited to the embodiment described with reference to the accompanying drawings and that the present invention may be carried out in other ways without departing from its true spirit and scope. The base only incompletely shown by the drawings may, by way of example, be provided with wheels to allow the apparatus to travel around the palleted load to be wrapped. Equally, the support 14 carrying the upstream prestretch roller 8 and its associated frictionally engageable wheel 12 may be moveable in lieu of or in addition to arm member 15. Cam roller 18 depicted in the accompanying drawings and carried by arm member 17 may, by way of a further example, be replaced by a wedgeshaped switching element which is exposed to a transverse force to move arm 15 into the disengaged position as cam member 21 is pushed down by the impact on the abutment surface 24. The abutment surface 24 and/or the cam surface 25 may further be suitably inclined.

What is claimed is:

1. An apparatus for spiral wrapping a load by a web of stretched plastic film wherein said load and a film dispenser means are rotated relative to each other during a wrapping cycle, said apparatus comprising:

a base with a base-mounted stand;

carriage means mounted on said stand moveably in the vertical direction, said film dispenser means being mounted on said carriage means;

a device for prestretching said web of stretchable plastic film before it reaches the load, said prestretching device being mounted on said carriage means and being adapted to receive said stretchable film pulled from said film dispenser means and having at least one rotatable prestretch roller coupled for simultaneous rotation with a frictionally engageable wheel means of a friction device and secured together with its associated frictionally engageable wheel means to a moveable support assembly, said friction device being disengaged in a first position of said support assembly and being engaged for elongating said web of stretchable plastic film being transported by said prestretch roller in a second position of said support assembly; and a switching assembly keeping said support assembly in said first position in a first phase of said wrapping cycle and thereafter allowing said support assembly to move into said second position until the end of said wrapping cycle for prestretching said web of stretchable plastic film, said switching assembly comprising a cam member supported on a base-mounted component, said cam member being in a guided fashion displaceable in a substantially vertical direction and having an upper abutment surface and a lateral cam surface;

spring means for pretensioning said cam member to move into an upper limit position; and a switching element coupled with said moveable support assembly, said switching element engaging said lateral cam surface during said first phase of said wrapping cycle thereby keeping said support assembly in said first position and engaging said abutment surface at a later and final phase of said wrapping cycle thereby pushing said cam member downward in a direction opposite to the direction in which the spring force of said spring means is applied.

2. An apparatus according to claim 1 wherein said moveable support assembly comprises at least one two-armed assembly moveable around a vertical axis, said assembly having a first arm member to which said prestretch roller and the frictionally engageable wheel means coupled coaxially therewith are secured and a second arm member to which said switching element is secured.

3. An apparatus according to claim 2 wherein said web of stretchable plastic film is transported over said at least one prestretch roller to said load so that said web is tensioned over said prestretch roller during said wrapping cycle pushing said prestretch roller with its support assembly into said second position whereby said friction device is engaged and said web of stretchable plastic film is caused to be prestretched.

4. An apparatus according to claim 3 wherein said switching element comprises a cam roller freely rotatable around a horizontal axis of rotation.

5. An apparatus according to claim 4 wherein said abutment surface of said cam member only engages in the vertical path of travel of one segment of the circumference of said cam roller when said support assembly is in said second position and wherein said axis of said cam roller rotation is outside said abutment surface so that said upwardly pretensioned cam member causes a lateral force to become effective upon contact of said segment of the circumference of said cam roller with said abutment surface thereby causing said cam roller to tend to move laterally to move said support assembly with its associated prestretch roller and frictionally engageable wheel means from said second position into said disengaged first position.

6. An apparatus according to claim 5 wherein said abutment surface is in a substantially horizontal plane and said cam surface extends substantially vertically.

7. An apparatus according to claim 1 further comprising spring means for pretensioning said moveable support assembly in said first position wherein said prestretch roller is disabled.

8. An apparatus for spiral wrapping a load by a web of stretched plastic film comprising a base with a base-mounted frame, a means for supporting a load, a first drive means to provide relative rotation of said load supporting means and said base, a carriage means mounted on said frame moveably in the vertical direction, guide means to guide said carriage along its vertical path of travel, a second drive means to cause said carriage means to travel up or down said vertical path of travel, a film dispenser roller mounted on said carriage means, a device for prestretching said web of stretchable plastic film before it reaches the load, said prestrech device mounted on said carriage means being adapted to receive said stretchable film from said film dispenser roller and comprising two prestretch rollers rotatable around two parallel axes, each such prestretch roller being coupled with a frictionally engageable wheel means of a friction device and being mounted on a support assembly, at least one of said two support assemblies being moveable around a vertical axis, said friction device being disengaged in a first position of said moveable support assembly and being engaged in a second position of said moveable support assembly by frictional contact between said frictionally engageable wheel means, each such frictionally engageable wheel means and its associated prestretch roller being designed so that the peripheral speed of the downstream roller is higher than the peripheral speed of the upstream roller to elongate said web of stretchable plastic film between said two parallel prestretch rollers and a switching assembly to control the position of said moveable support assembly during each wrapping cycle in order to wrap the load at reduced tension during a first phase of said wrapping cycle and thereafter to enable said prestretch device automatically until the end of each such wrapping cycle, said switching assembly comprising a cam member supported on a base-mounted component, said cam member being in a guided fashion displaceable in a substantially vertical direction and having an upper abutment surface and a lateral cam surface, spring means for pretensioning said cam member to reach an upper limit position and a switching element coupled with said moveable support assembly, said switching element engaging said lateral cam surface thereby keeping said support assembly in its first position during said first phase of said wrapping cycle and engaging said abutment surface at a final phase of said wrapping cycle thereby pushing said cam member downward in a direction opposite to the tensioning direction of said spring means.

9. An apparatus according to claim 8 wherein said switching element comprises a cam roller freely rotatable around a horizontal axis of rotation.

10. An apparatus according to claim 9 wherein said abutment surface of said cam member engages in the vertical path of travel only of one segment of the circumference of said cam roller when said support assembly is in said second position and wherein said axis of cam roller rotation is outside said abutment surface so that said upwardly pretensioned cam member causes a lateral force to become effective upon contact of said segment of the circumference of said cam roller with said abutment surface thereby causing said cam roller to tend to move laterally to move said support assembly with its associated prestretch roller and frictionally engageable wheel means from said second position into said disengaged first position.

11. An apparatus according to claim 10 wherein said moveable support assembly comprises at least one two-armed assembly moveable around a vertical axis, said assembly having a first arm member to which said moveable prestretch roller and the frictionally engageable wheel means coupled coaxially therewith are secured and a second arm member to which said switching element is secured.

12. An apparatus according to claim 11 wherein said abutment surface is in a substantially horizontal plane and said cam surface extends substantially vertically.

13. An apparatus according to claim 12 further comprising spring means for pretensioning said moveable support assembly in said first position wherein said prestretch roller is disabled.

14. An apparatus according to claim 8 wherein said base is provided with wheels to allow said apparatus to travel.

* * * * *